US008744110B2

(12) United States Patent
Akino

(10) Patent No.: US 8,744,110 B2
(45) Date of Patent: Jun. 3, 2014

(54) UNIDIRECTIONAL DYNAMIC MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/404,792

(22) Filed: Feb. 24, 2012

(65) Prior Publication Data

US 2012/0224736 A1 Sep. 6, 2012

(30) Foreign Application Priority Data

Mar. 2, 2011 (JP) ..... 2011-045299

(51) Int. Cl.
*H04R 1/00* (2006.01)

(52) U.S. Cl.
USPC ..... 381/356; 381/368; 381/355

(58) Field of Classification Search
USPC ..... 381/361, 368, 355, 356, 357
See application file for complete search history.

(56) References Cited

U.S. PATENT DOCUMENTS

| | | | | |
|---|---|---|---|---|
| 5,988,585 | A * | 11/1999 | Eaton | 248/638 |
| 6,128,393 | A * | 10/2000 | Kondo | 381/368 |
| 2005/0226450 | A1 * | 10/2005 | Akino | 381/361 |
| 2007/0238358 | A1 * | 10/2007 | Akino | 439/610 |
| 2009/0067660 | A1 * | 3/2009 | Murata | 381/361 |

FOREIGN PATENT DOCUMENTS

| | | |
|---|---|---|
| JP | 5-49090 | 2/1993 |
| JP | 2005-277652 | 10/2005 |

* cited by examiner

*Primary Examiner* — Duc Nguyen
*Assistant Examiner* — Phan Le
(74) *Attorney, Agent, or Firm* — Whitham Curtis Christofferson & Cook, PC

(57) ABSTRACT

A unidirectional dynamic microphone includes a grip housing, a microphone unit supported at a first end of the grip housing, a plug assembly attached to a second end of the grip housing and connected to the microphone unit through a lead line, and an air room serving as a part of an acoustic circuit of the microphone unit in the grip housing. The grip housing has a fitting part for the plug assembly and an expanded portion. The plug assembly fitted in the fitting part is fixed within the grip housing by an elastic ring and a pressure ring fitted in the expanded portion. The elastic ring seals a space between the grip housing and the plug assembly.

7 Claims, 7 Drawing Sheets

RELATED ART

RELATED ART

UNIDIRECTIONAL DYNAMIC MICROPHONE

TECHNICAL FIELD

The present invention relates to a unidirectional dynamic microphone, in which the entire inside of a grip housing functions as an air room so as to capture nondirectional components sufficiently even at a bass tone and a microphone connector can be easily extracted from a rear end of the microphone for replacement.

BACKGROUND ART

An air room is one of the factors determining frequency characteristics of a unidirectional dynamic (electromotive) microphone as is disclosed in Japanese Unexamined Patent Application Publication No. 05-049090. A hand-held microphone such as a vocal microphone typically has an air room in a cylindrical grip housing. FIG. 6 illustrates an example of such a microphone.

A hand-held unidirectional dynamic microphone includes, for example, a cylindrical grip housing 10 formed by die casting, and a microphone unit 20 supported at a first end of the grip housing 10. The microphone unit 20 incorporates a diaphragm (not shown), to which a voice coil is attached, and a magnetic generator circuit (not shown) having a magnetic gap, where the voice coil is disposed so as to vibrate with the diaphragm within the magnetic gap.

The microphone unit 20 has unidirectionality and thus includes a front acoustic terminal 20*a* and a rear acoustic terminal 20*b*. The microphone unit 20 is attached to the first end of the grip housing 10 with a coupling ring 11 therebetween while the rear end of the microphone unit is hermetically inserted in the coupling ring 11. An elastomeric shock mounting member 12 is provided between the coupling ring 11 and the grip housing 10 in order to reduce handling noise. A pressure ring 13 is also provided.

A connector storage 14 is integrally provided at a second end of the grip housing 10, and a plug assembly 30 is mounted as an output connector within the connector storage 14. The microphone unit 20 is connected to the plug assembly 30 through an undepicted lead line. The inside of the grip housing 10 is a cavity that acts as an air room 10*a* of the microphone unit 20.

The air room 10*a* preferably has a large capacity improving sound quality in a low frequency range. In any case, air should not enter the air room 10*a* from the outside for satisfactory directionality. The inside of the grip housing 10 has been therefore sealed at the second end having the plug assembly 30 with, for example, a silicone sealant 15 after the microphone unit 20 is connected to the plug assembly 30 through the lead line. The plug assembly 30 is inserted/extracted into/from the grip housing 10 at the first end of the grip housing 10 for assembling the dynamic microphone or replacing the plug assembly 30.

Japanese Unexamined Patent Application Publication No. 2005-277652 discloses another embodiment of a dynamic microphone having an air room in a grip housing. A special component for the air room is coupled to the rear of a microphone unit.

This unidirectional dynamic microphone includes a grip housing 100, a cavity sleeve 200, a dynamic microphone unit 20, and a plug assembly 30 as shown in FIG. 7.

The microphone unit 20 has unidirectionality and thus includes a front acoustic terminal 20*a* and a rear acoustic terminal 20*b*. In addition, the microphone unit 20 is of a dynamic type, and thus it incorporates a diaphragm (not shown), to which a voice coil is attached, and a magnetic generator circuit (not shown) having a magnetic gap, where the voice coil is disposed so as to vibrate with the diaphragm within the magnetic gap.

The plug assembly 30 is a 3-pin connector having a cylindrical base 31 including an electric insulator, through which a first ground pin (omitted in the drawing), a second pin 32 for a hot part of signals, and a third pin 33 for a cold part thereof penetrate. The connector further includes a screw 34 that moves in a radial direction of the base 31 and a ground terminal plate 35 having an internal thread for the screw 34, where the ground terminal plate 35 is electrically conducted to the first ground pin through an undepicted fitting.

The microphone unit 20 and the plug assembly 30 are attached to the cavity sleeve 200. The cavity sleeve 200 has a cylindrical shape formed by die casting, where the inside of the cavity is used as an air room 201 as a part of an acoustic circuit of the microphone unit 20. The rear end of the microphone unit 20 is inserted into one end (front end) of the cavity sleeve 200 and thus the microphone unit 20 is supported by the cavity sleeve 200. While the plug assembly 30 is normally attached to the cavity sleeve 200, it is inserted/extracted into/from a grip housing 10 together with the cavity sleeve 200 at the one end of the grip housing 10, at which the microphone unit 20 is supported, for assembling or replacing the dynamic microphone. In this embodiment of dynamic microphone, while the inside of the cavity sleeve 200 functions as an air room, the inside of the grip housing does not entirely function as the air room, limiting the capacity of the air room.

In a still another embodiment of the dynamic microphone having an air room in a grip housing, a connector attachment of the grip housing has a slope, and an elastomer ring is attached to a connector. In this dynamic microphone, the elastomer ring is urged to the slope after assembling of the microphone, so that the inside of the grip housing is sealed. In such a dynamic microphone, the plug assembly is also inserted/extracted into/from the grip housing at the one end thereof, at which the microphone unit is supported, for assembling or replacing the dynamic microphone.

SUMMARY OF INVENTION

Technical Problem

The 3-pin plug assembly provided at the rear end of the dynamic microphone is worn away rapidly since a microphone cord is frequently attached to or detached from the plug assembly. Hence, the plug assembly should preferably be easily replaced or repaired.

In any of the conventional dynamic microphones, the plug assembly must be inserted/extracted into/from the grip housing at its one end, at which the microphone unit is supported. In such operation, the plug assembly must be inserted/extracted together with all other components in the grip housing, leading to a complicated operation.

An object of the present invention is to provide a unidirectional dynamic microphone, where the entire inside of a grip housing functions as an air room after assembling the dynamic microphone, a high air-tight state is maintained, a plug assembly is extracted from an end of the grip housing, at which a microphone unit is not supported, and the plug assembly is easily replaced or repaired.

Solution to Problem

A unidirectional dynamic microphone according to the present invention includes a cylindrical grip housing; a microphone unit supported at a first end of the grip housing; a plug assembly attached to a second end of the grip housing and connected to the microphone unit through a lead line; and an air room serving as a part of an acoustic circuit of the microphone unit in the grip housing, wherein the grip housing has a fitting part for the plug assembly inserted from the second end of the grip housing, and has an expanded portion closer to the second end than the fitting part, the plug assembly fitted in the fitting part is fixed within the grip housing by an elastic ring fitted in the expanded portion so as to be bouncy both in a thickness direction and a radial direction and a pressure ring fitted in the expanded portion at a position closer to the second end than the elastic ring, and the elastic ring seals a space between the grip housing and the plug assembly.

DESCRIPTION OF EMBODIMENT

Figure 1B:
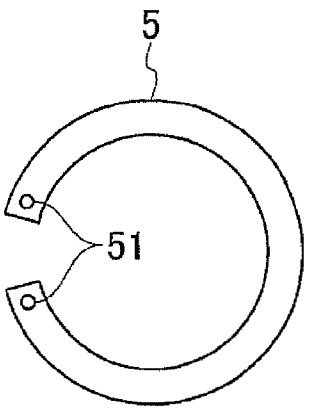
FIG. 1B is a front view of a pressure ring of the exemplary microphone.
Figure 1A:
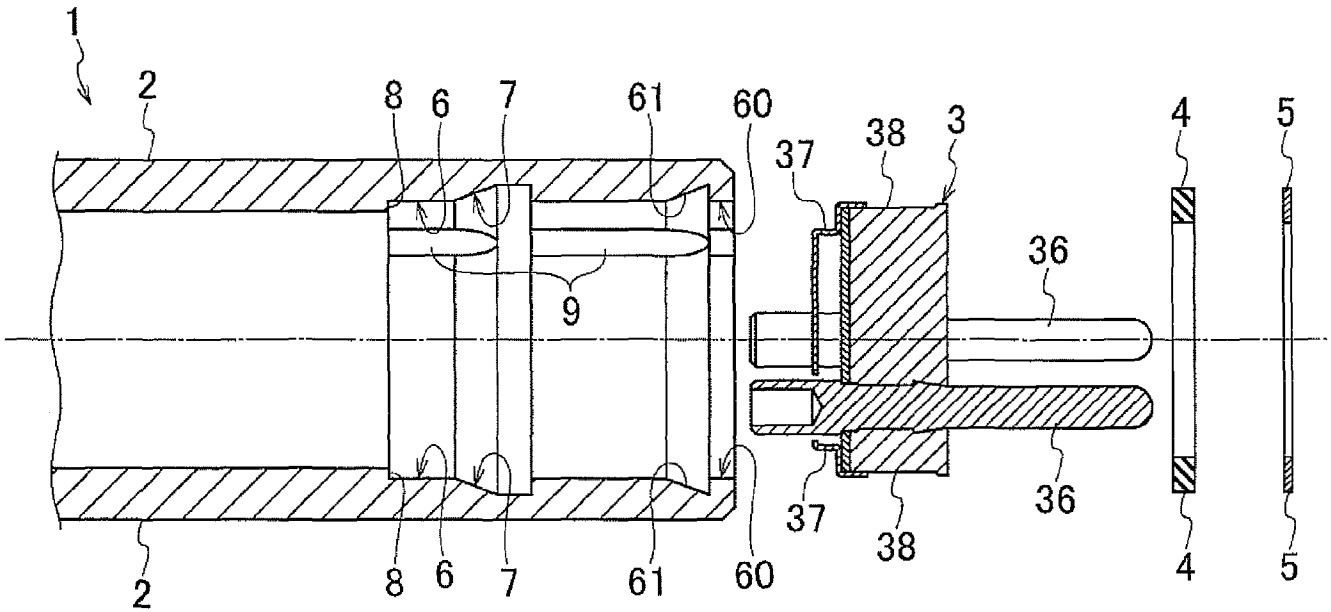
FIG. 1A is an exploded longitudinal view of the major part of an exemplary unidirectional dynamic microphone according to the present invention.
Figure 2B:
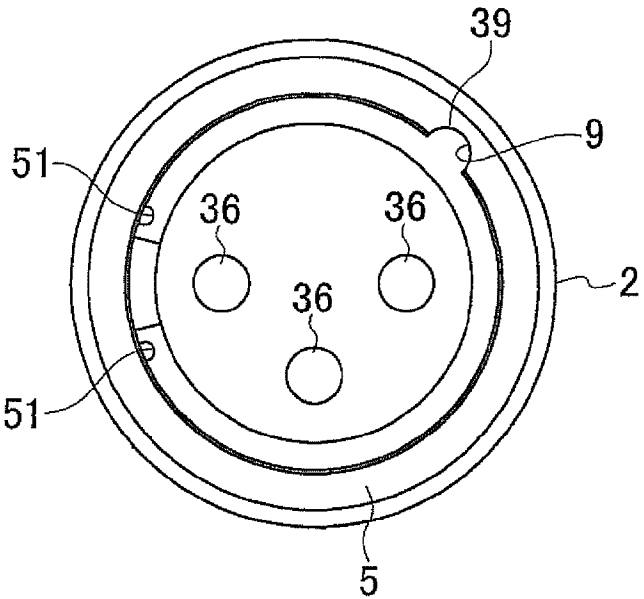
FIG. 2B is a bottom view of the exemplary microphone.
Figure 2A:
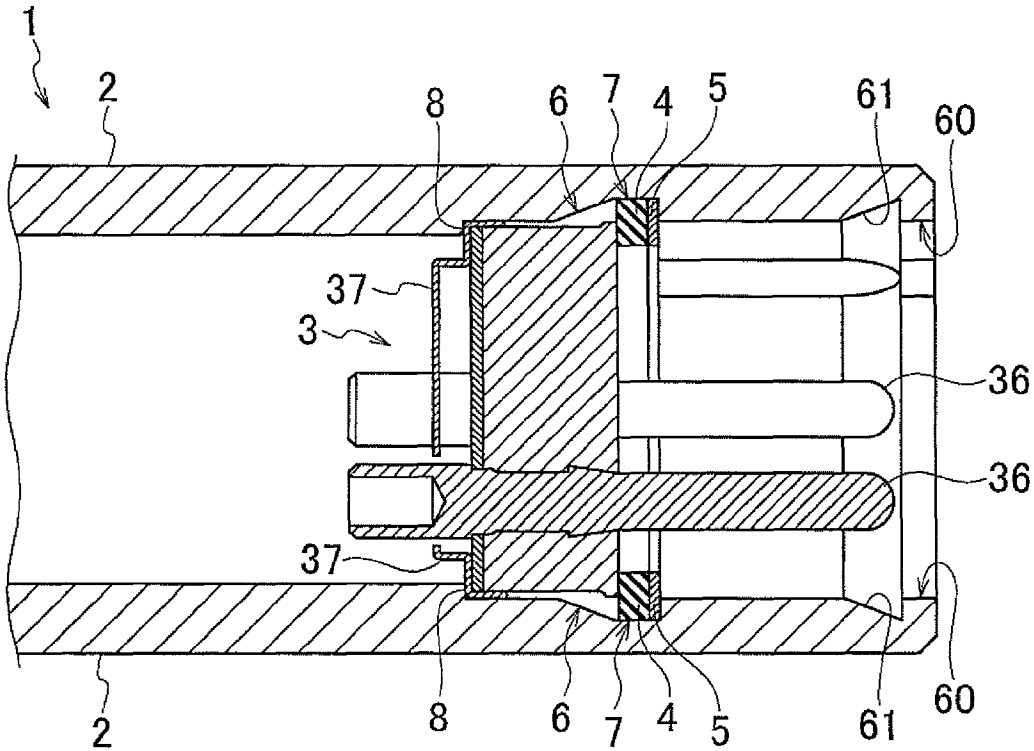
FIG. 2A is a longitudinal view of the major part of the unidirectional dynamic microphone of FIG. 1A in an assembled state.

Hereinafter, a unidirectional dynamic microphone according to an embodiment of the present invention is described with reference to the accompanying drawings.

In the unidirectional dynamic microphone according to the present invention, a portion at a front end thereof, at which a dynamic microphone unit is provided, may be appropriately designed. For example, the microphone may have the same configuration as each of the conventional dynamic microphones. The following description focuses on the configuration at the other end of the microphone.

As shown in FIGS. 1A to 2B, the unidirectional dynamic microphone 1 has a microphone unit (not shown) at a first end of a grip housing 2. A plug assembly 3 is attached to a second end of the grip housing 2 and connected to the microphone unit through a lead line (not shown).

The microphone unit has unidirectionality and thus has a front acoustic terminal and a rear acoustic terminal. In addition, the microphone unit is of a dynamic type and thus incorporates a diaphragm (not shown), to which a voice coil is attached, and a magnetic generator circuit (not shown) having a magnetic gap. The voice coil is disposed so as to vibrate with the diaphragm within the magnetic gap.

The cylindrical grip housing 2 has a cylindrical shape formed by die casting and has a cavity therein. The cavity acts as an air room of the unidirectional dynamic microphone unit. The microphone unit is attached to the first end of the grip housing 2 such that the rear acoustic terminal is coupled to the air room in the grip housing 2.

At the second end of the grip housing 2, a fitting part 6 having a certain inner diameter to allow insertion of the plug assembly 3 and an expanded portion 7 having a larger inner diameter than the fitting part 6 are provided on an inner wall of the grip housing 2. The plug assembly 3 is inserted from the second end of the grip housing 2 so as to abut a step provided on the inner wall of the grip housing 2.

The plug assembly 3 is a 3-pin connector having a cylindrical base 38 including an electric insulator, through which three pins 36, i.e., a first ground pin (omitted in the drawing), a second pin for a hot part of signals, and a third pin for a cold part of the signals, penetrate. The connector further includes a shield plate 37 on an inner surface of the base 38, where the shield plate 37 is electrically conducted to the first ground pin through an undepicted fitting.

To assemble the microphone 1, the plug assembly 3 is inserted into the fitting part 6 from the second end of the grip housing 2 through the expanded portion 7. After being inserted into the fitting part 6, the plug assembly 3 abuts the step 8 provided at the back of the fitting part 6 so as to be positioned in a longitudinal direction of the grip housing 2. During insertion of the plug assembly 3 into the fitting part 6, a projection 39 of the assembly 3 fits in a groove 9 provided on the inner wall of the grip housing 2 so that the plug assembly 3 is positioned in a rotational direction.

An elastic ring 4 and a pressure ring 5 are then inserted in this order into the expanded portion 7 from an opening 60 at the second end, so that the assembly 3 inserted in the fitting part 6 is fixed. The elastic ring 4 and the pressure ring 5 each have a diameter that is larger than the inner diameter of the fitting part 6 and smaller than the inner diameter of the expanded portion 7.

The elastic ring 4 is formed of an elastic material such as a closed-cell sponge, and is bouncy both in the thickness direction and the radial direction. The pressure ring 5 is a C ring that is bouncy in the radial direction, and tightly fits in the expanded portion 7 of the grip housing due to its expandable elasticity. As shown in FIG. 1B, the pressure ring 5 has two holes 51 for engagement with a C-ring plier for radially expanding or contracting the pressure ring 5. The elastic ring 4 is elastically deformed with a forceps or any other tool for tight fitting of the ring in the expanded portion 7. The pressure ring 5 is deformed in the contracting direction with the C-ring plier for insertion into the flare portion 7, and then released so as to be re-deformed in the expanding direction for tight fitting of the ring 5 in the expanded portion 7.

To extract the assembly 3 from the grip housing 2, the pressure ring 5 is deformed in the tapering direction with the C-ring plier so as to be removed from the expanded portion 7 to the outside of the grip housing 2. The elastic ring 4 is then elastically deformed with the forceps or any other tool so as to be removed from the expanded portion 7 to the outside of the grip housing 2. The elastic ring 4 and the pressure ring 5 are removed in this way and thus fixing of the plug assembly 3 is released, so that the plug assembly 3 can be extracted from the opening 61 at the second end of the grip housing 2 to the outside of the grip housing.

Figure 5:
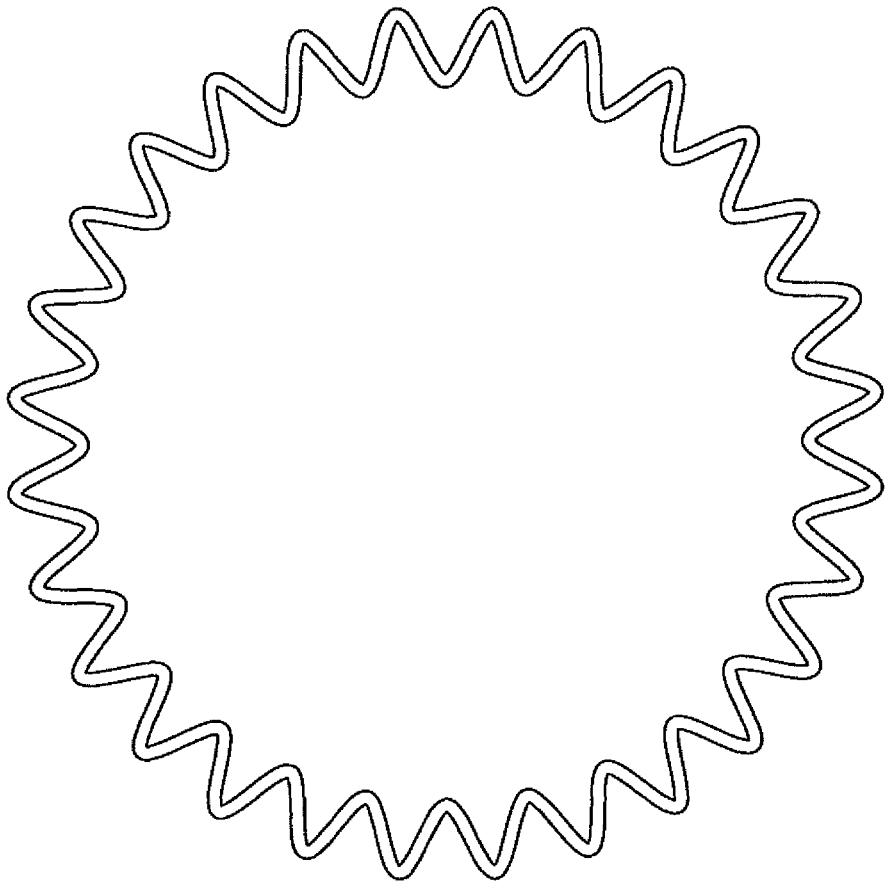
FIG. 5 is a front view illustrating a modification of a wire spring used as a pressure ring.
Figure 6:
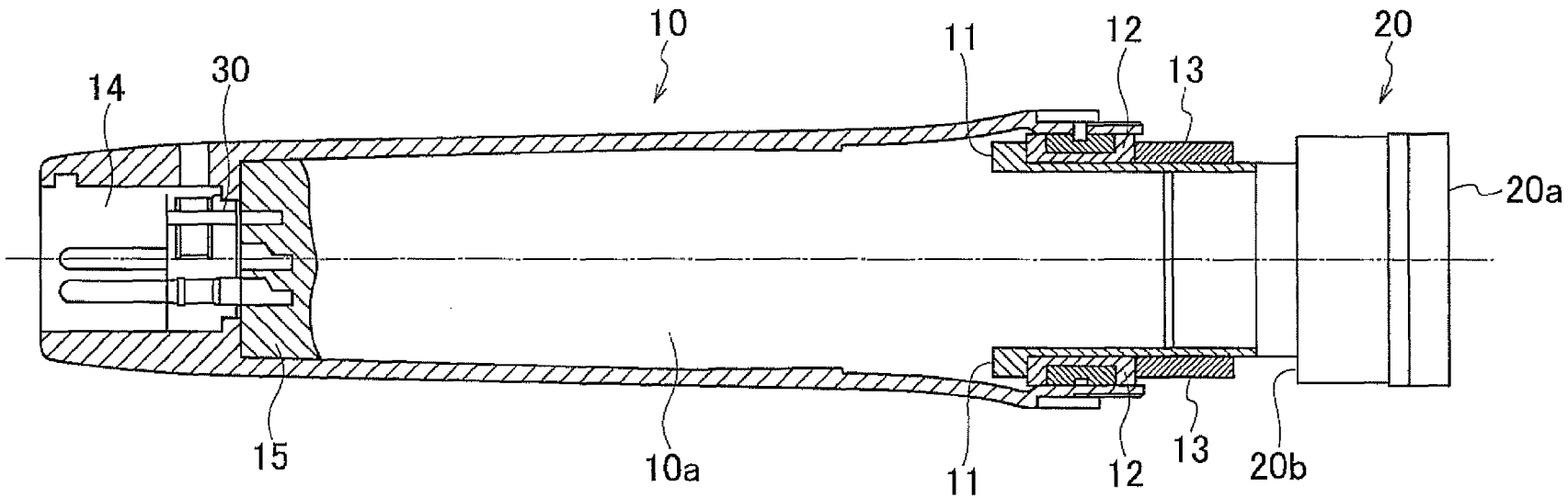
FIG. 6 is a longitudinal view illustrating a typical conventional unidirectional dynamic microphone.
Figure 7:
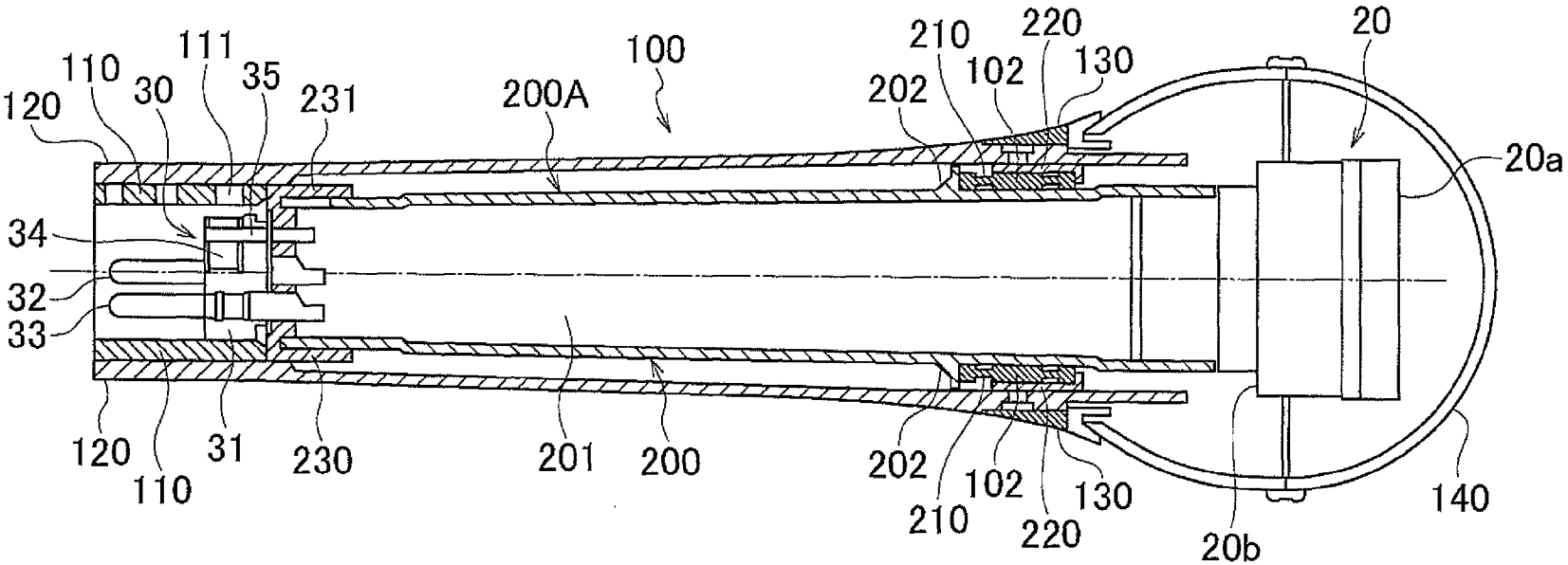
FIG. 7 is a longitudinal view illustrating another typical conventional unidirectional dynamic microphone.

While the C ring is used as the pressure ring 5 in the embodiment, various other components, which are bouncy in the radial direction and can be tightly fitted in the expanded portion 7 of the grip housing due to elasticity in an expanding direction, can be used without any limitation in the present invention. For example, the pressure ring 5 may include a ring of a wire spring folded into a wavy pattern as shown in FIG. 5.

Figure 3:
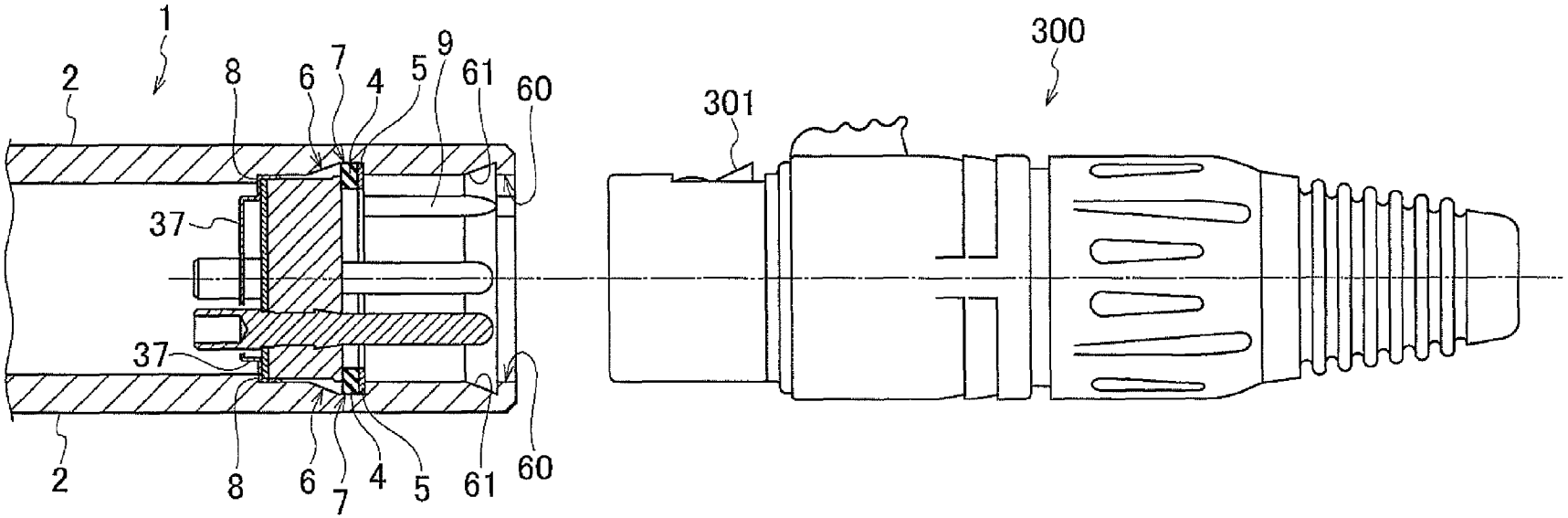
FIG. 3 is a partial sectional view illustrating insertion of a cord plug into the unidirectional dynamic microphone of FIG. 2A.
Figure 4:
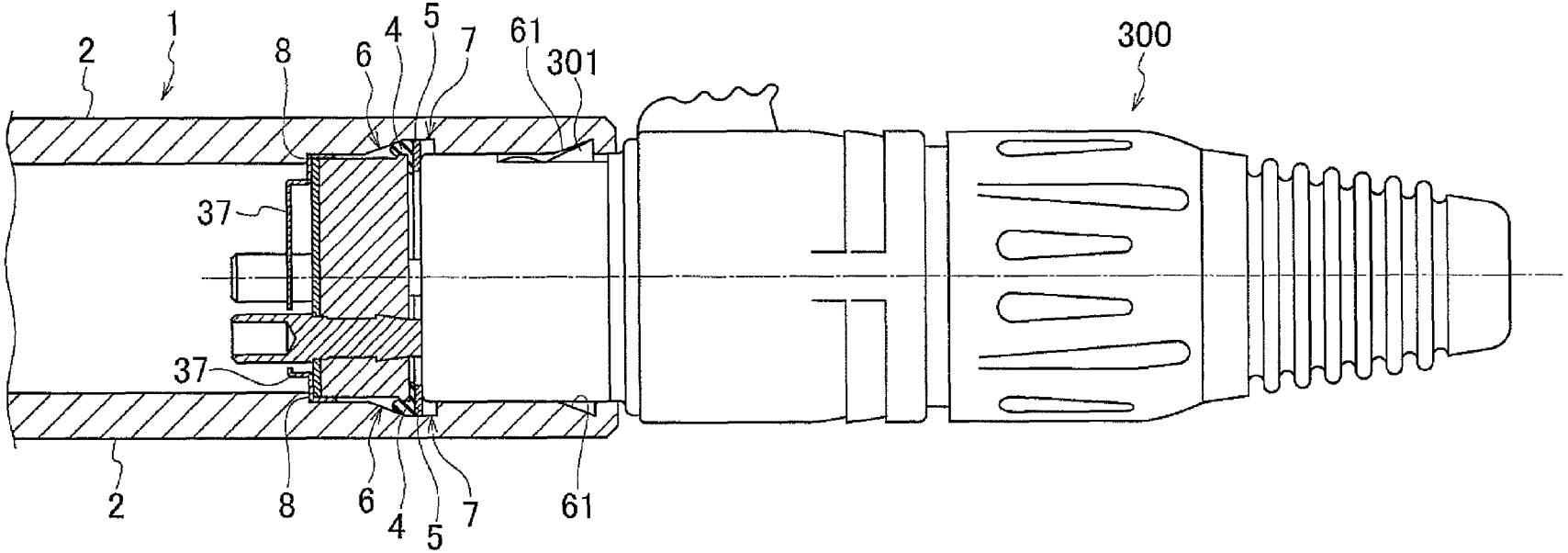
FIG. 4 is a partial sectional view illustrating the cord plug inserted in the unidirectional dynamic microphone of FIG. 2A.

A cord plug 300 is coupled to the plug assembly 3 for connecting the microphone 1 to an external device. This is described with reference to FIGS. 3 and 4. The cord plug 300 corresponds to the 3-pin connector, and has three holes (not shown), into which the three pins 36 of the plug assembly 3 are inserted, at a front end of the plug. The cord plug 300 is inserted from an opening 60 at the second end of the grip housing 2, and the front end of the cord plug 300 urges the elastic ring 4, so that the elastic ring is elastically deformed. Such an elastically deformed elastic ring 4 seals a space between the plug assembly 3 and the inner wall of the grip housing 2. As a result, the inside of the grip housing 2 is air-tight, so that the entire inside of the grip housing 2 functions as a sealed air room.

After the cord plug 300 is inserted into the grip housing 2 from the opening 60, a latching pawl 301 provided near the front end of the plug 300 latches on a latching recess 61 provided near the opening 60 of the grip housing 2. As a result, the cord plug 300 is fixed within the grip housing 2.

The cord plug 300 is inserted and fixed in the grip housing 2 in this way, and the elastic ring 4 seals the space between the plug assembly 3 and the inner wall of the grip housing 2. As a result, the inside of the grip housing 2 is air-tight. In addition, the cord plug 300 is fixed to the inner wall of the grip housing 2 through an effect of the latching pawl 301 due to elasticity of the elastic ring 4, so that backlashes of the cord plug 300 can be prevented.

As described above, according to the unidirectional dynamic microphone according to the present invention, the entire inside of a grip housing functions as an air room after assembling the dynamic microphone, and a high air-tight state is maintained. In addition, a plug assembly is extracted from a rear end of the grip housing, so that the plug assembly can be easily replaced or repaired.

The invention claimed is:

1. A unidirectional dynamic microphone comprising:

a cylindrical grip housing;

a microphone unit supported by the grip housing at a first end of the grip housing;

a plug assembly attached to a second end of the grip housing and connected to the microphone unit through a lead line; and an air room serving as a part of an acoustic circuit of the microphone unit in the grip housing, wherein the grip housing has a fitting part for the plug assembly inserted from the second end of the grip housing, and has an expanded portion closer to the second end than the fitting part, the plug assembly is removably fixed within the grip housing by an elastic ring fitted in the expanded portion so as to be bouncy both in a thickness direction and a radial direction and a pressure ring fitted in the expanded portion at a position closer to the second end of the grip housing than the elastic ring, and the elastic ring seals a space between the grip housing and the plug assembly and maintains a high air-tight state, and wherein the pressure ring is bouncy in a radial direction, and tightly fitted in the expanded portion of the grip housing due to elasticity of the pressure ring in an expanding direction, wherein the pressure ring is either a C ring or comprises a wire spring.

2. The unidirectional dynamic microphone according to claim 1, wherein the pressure ring comprises a ring of the wire spring folded into a wavy pattern.

3. The unidirectional dynamic microphone according to claim 1, wherein the elastic ring comprises a sponge material.

4. The unidirectional dynamic microphone according to claim 2, wherein the elastic ring comprises a sponge material.

5. A unidirectional dynamic microphone comprising:

a cylindrical grip housing;

a microphone unit supported by the grip housing at a first end of the grip housing;

a plug assembly attached to a second end of the grip housing and connected to the microphone unit through a lead line;

an air room serving as a part of an acoustic circuit of the microphone unit in the grip housing;

a fitting part within the grip housing for the plug assembly inserted from the second end of the grip housing;

an expanded portion within the grip housing; and a step within the grip housing, wherein the plug assembly is fixed within the grip housing by an elastic ring fitted in the expanded portion so as to be bouncy both in a thickness direction and a radial direction and a pressure ring fitted in the expanded portion, wherein the plug assembly abuts the elastic ring which abuts the pressure ring which abuts the step so as to position the plug assembly in a longitudinal direction of the grip housing, and the elastic ring seals a space between the grip housing and the plug assembly and maintains a high air-tight state, and wherein the pressure ring is bouncy in a radial direction, and tightly fitted in the expanded portion of the grip housing due to elasticity of the pressure ring in an expanding direction, wherein the pressure ring is either a C ring or comprises a wire spring.

6. The unidirectional dynamic microphone according to claim 5, wherein the pressure ring comprises a ring of the wire spring folded into a wavy pattern.

7. The unidirectional dynamic microphone according to claim 5, wherein the elastic ring comprises a sponge material.

* * * * *